United States Patent [19]

Haynes

[11] 4,236,775

[45] Dec. 2, 1980

[54] STORAGE HOLDER FOR FIREWOOD AND THE LIKE

[76] Inventor: Elwood W. Haynes, 6306 Pizzaro St., Duluth, Minn. 55807

[21] Appl. No.: 46,648

[22] Filed: Jun. 8, 1979

[51] Int. Cl.[3] ..... A47F 7/00; A47B 88/00; A47B 83/00

[52] U.S. Cl. ..... 312/351; 312/237; 211/60 R; 248/152

[58] Field of Search ..... 312/351, 237; 211/60 R, 211/20; 248/152, 153

[56] References Cited

U.S. PATENT DOCUMENTS

| | | | |
|---|---|---|---|
| 484,718 | 10/1892 | Isaacs | 312/237 |
| 644,513 | 2/1900 | Hall | 312/351 |
| 2,539,276 | 1/1951 | Schmeling | 211/60 R |
| 2,990,228 | 6/1961 | Celler | 312/351 |
| 3,187,901 | 6/1965 | Wilson | 211/60 R |
| 3,446,394 | 5/1969 | Miller et al. | 248/152 |
| 3,559,812 | 2/1971 | Wolf | 211/60 R |
| 3,590,752 | 7/1971 | DePew | 211/60 R |
| 3,658,195 | 4/1972 | Fantin | 211/60 R |

*Primary Examiner*—Victor N. Sakran
*Attorney, Agent, or Firm*—Wicks & Nemer

[57] ABSTRACT

A storage holder for firewood and the like including a cradle having arcuate first and second end walls spaced at the lower ends to form an opening. The end walls have secured thereto first and second pairs of legs secured to the lower ends of the end walls. Secured to each of the pairs of legs is an inter-mediate wall the lower end of which is spaced from the lower end of the end wall.

A drawer is slidably mounted on the pairs of legs beneath the opening. Secured to the lower ends of the end walls and extending across the opening are a plurality of spaced rods to limit the size of objects that may fall through the opening and into the drawer.

7 Claims, 5 Drawing Figures

STORAGE HOLDER FOR FIREWOOD AND THE LIKE

SUMMARY

The invention relates to an improvement in a storage holder for firewood and the like. It is an object of the invention to provide a device which holds logs and kindling in stacked relation and which includes a cradle having arcuate end members spaced at the lower ends to form an opening therebetween. Slidably positioned below the opening is a drawer which catches debris falling from logs and kindling stacked between the pairs of legs which support the cradle. Each of the pairs of legs has an intermediate wall therebetween the lower end of which is spaced from the lower end of the end wall to allow debris collecting between the end walls and the intermediate wall to pass under the intermediate wall and downwardly into the catch drawer. Large logs may be stacked between the pair of legs and smaller logs, kindling and paper may be stored between the intermediate walls and the end members. Debris falling from logs between the end walls and the intermediate walls slides down the inside surface of the arcuate end members and into the drawer by which the debris is collected and with which debris may be removed.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
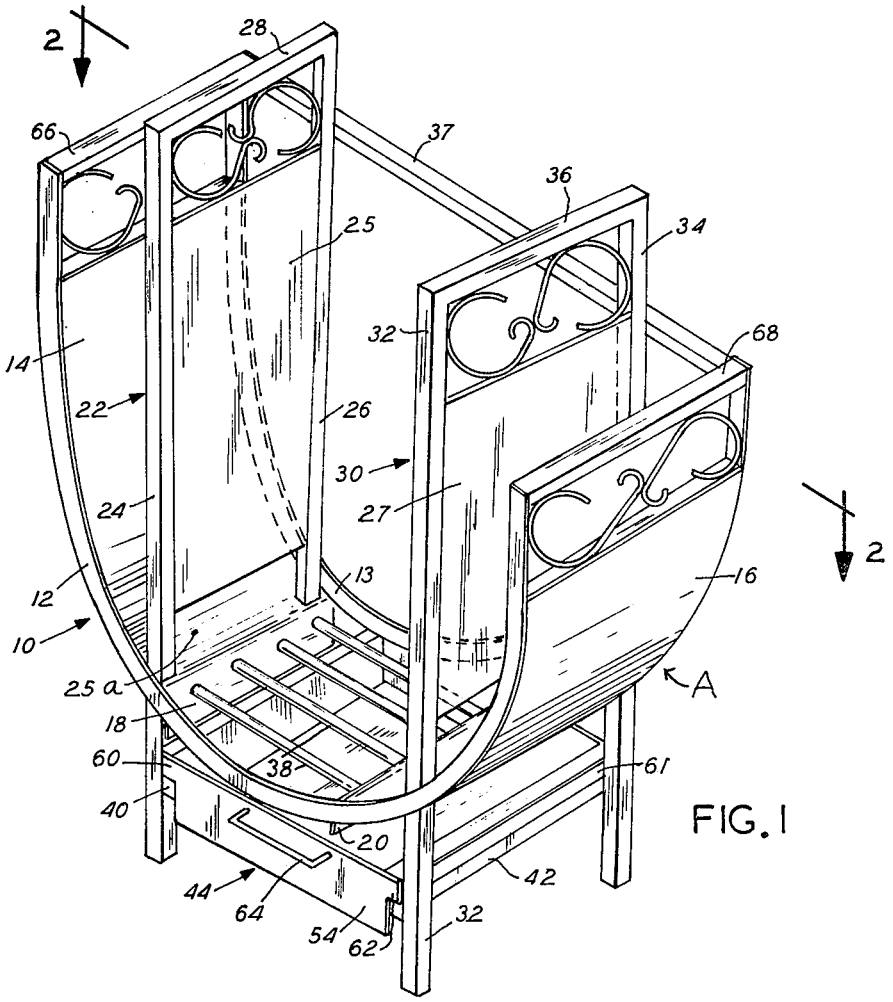
FIG. 1 is a perspective view of a holder for firewood and the like embodying the invention.
Figure 2:
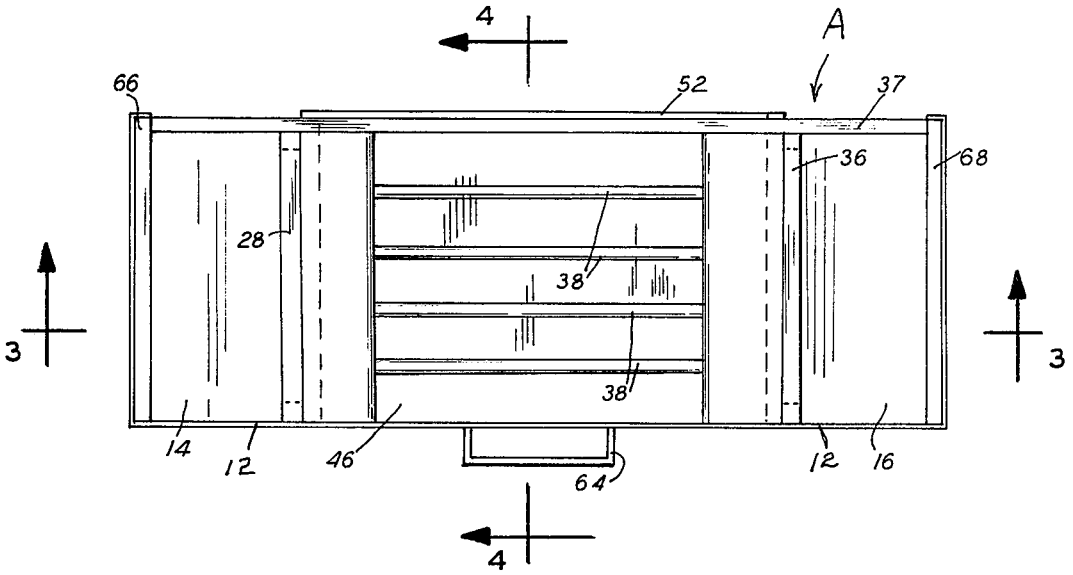
FIG. 2 is a top plan view thereof.
Figure 3:
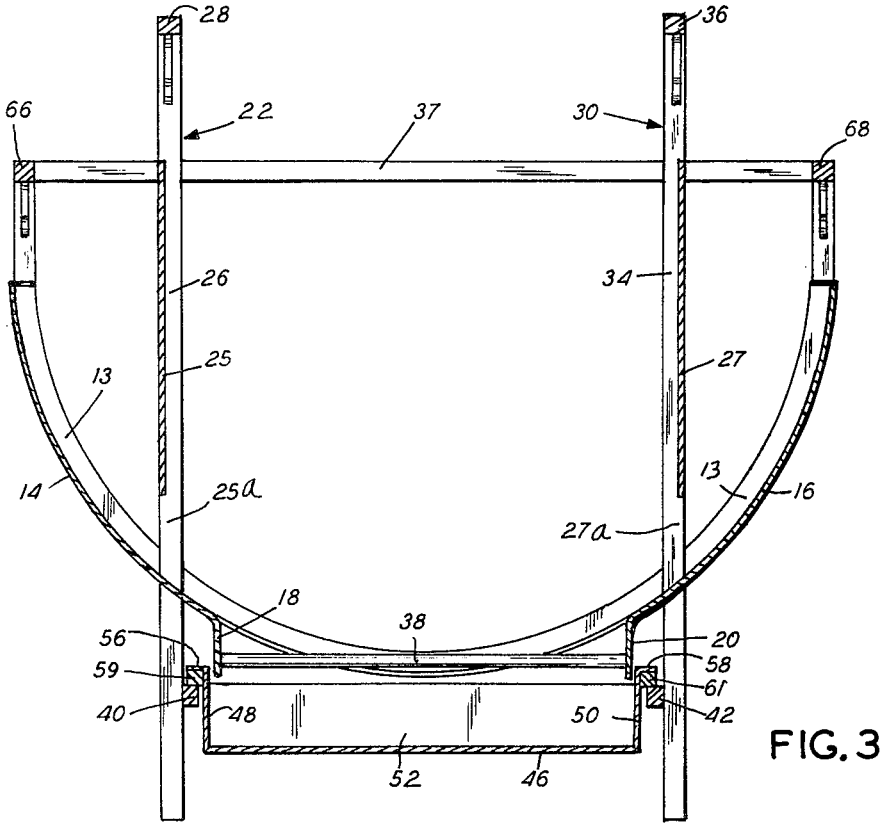
FIG. 3 is a sectional view on the line 3—3 of FIG. 2.
Figure 4:
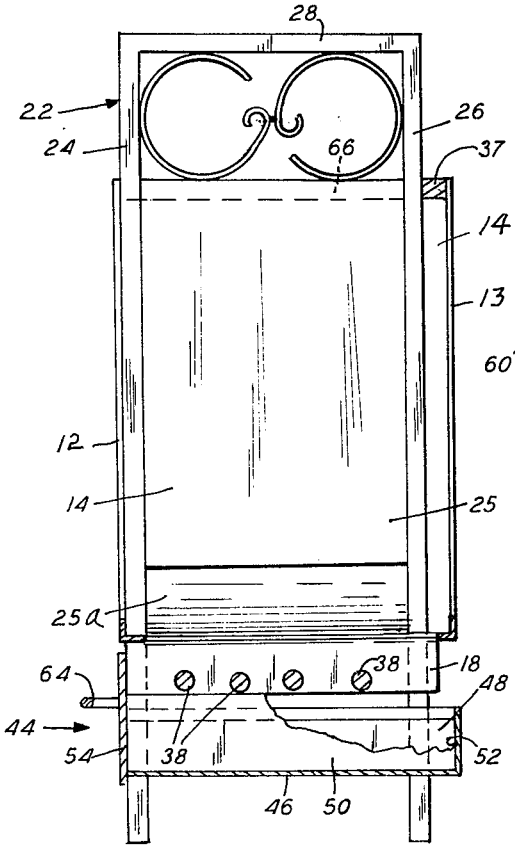
FIG. 4 is a sectional view on the line 4—4 of FIG. 2.
Figure 5:
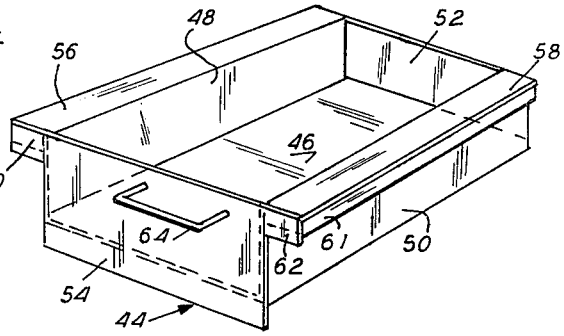
FIG. 5 is a perspective view of the catch drawer removed from the log holder.

Referring to the drawings in detail, the holder for firewood and the like A includes the cradle 10 which includes first and second U-shaped edge supports 12 and 13 secured to the edges of an arcuately formed first end wall 14. A second end wall 16 identical to end wall 14 is provided and also secured to the supports 12 and 13 in opposed relation to end wall 14 with the lower edges of the end walls in spaced relation.

The lower end of the end wall 14 is formed with the depending lip 18, and the lower end of the end wall 16 is formed with the depending lip 20. Further provided is a first upright support 22 which includes a first leg 24 which extends through a hole formed in the lower portion of the end wall 14 adjacent the lip 18. The numeral 26 designated a second leg which extends through a hole formed in the lower portion of the end wall adjacent the lip 18. The tops of the legs 24 and 26 are connected by a cross bar 28 which rijidifies the legs and which can be used as a handle in transporting the holder A.

Additionally provided is a second upright support 30 which includes a first leg 32 which extends through a hole formed in the lower portion of the end wall 16 adjacent the lip 20. The support 30 includes a second leg 34 which extends through a hole formed in the lower portion of the end wall adjacent the lip 20. The tops of the legs 32 and 34 are connected by the cross bar 36 which rigidifies the legs 32 and 34 and which can be used as a handle in transporting the holder. To support the upper ends of the cradle 10 the bar 37 connects the top ends of the support 13 and the legs 26 and 34. Secured to and extending between the legs 24 and 26 is the first intermediate wall 25 the lower edge of which is spaced from the lower end of the end wal 14 where the depending lip originates thereby forming an opening 25*a* below the edge of the first intermediate wall 25. Similarly a second intermediate wall 27 is secured to and extending between the legs 32 and 34 the lower edge of the wall 27 spaced from the lower end of end wall 16 where the depending lip 20 originates thereby forming an opening 27*a* below the edge of the second intermediate wall 27.

Further provided are the spaced grate rods 38 connected at the ends to the lip 18 and lip 20 so as to limit the size of objects falling between the end walls 14 and 16. A first drawer guide 40 is secured to the legs 24 and 26 with a second drawer guide 42 secured to the legs 32 and 34 below the lower ends of the end walls. A receptacle in one form of the drawer 44 is provided which includes the bottom 46, the sidewalls 48 and 50, the rear end wall 52 and the front wall 54. The top edge of the sidewall 48 is formed with the lip 56 and the sidewall 50 with the lip 58. The lips 56 and 58 each have a runner piece 59 and 61, respectively, secured to the underside of the lip for sliding engagement with the top surfaces of the guides 40 and 42.

The front end of each lip 56 and 58 is formed with a stop 60 and 62, respectively, which engage the front ends of the guides 40 and 42 to thereby position the drawer, when closed, directly beneath the grate rods 38. The drawer has secured to the front wall 54 the handle 64 for withdrawing and closing the drawer. The top of the end wall 14 is finished off with the top block 66, and the top of the end wall 16 is finished off with the top block 68.

OPERATION

In use of the device A logs are positioned between the legs 24–26 and 32–34 and any debris falling from the logs descends past the rods 38 and into the drawer 44 where it may be retrieved. Logs may also be positioned between the logs 24–26 and end wall 14 and also between legs 32–24 and end wall 16, and any debris falling from the logs will fall down the end walls and through the openings 25*a* and 27*a* into the drawer 44. Newspaper and the like may be easily and effectively stored between legs 24–26 and end wall 14 and similarly with regard to legs 32–34 and end wall 16.

Having thus described the invention, what is claimed as new and desired to be secured by Letters Patent is:

1. A storage holder for firewood and the like comprising:

(a) a cradle having arcuate first and second opposed end walls spaced at the lower ends to form an opening therebetween, (b) a first pair of spaced legs carried by and extending below said first end wall, (c) a second pair of spaced legs carried by and extending below said second end wall, (d) an intermediate wall extending between each of said first and second spaced legs, (e) a receptacle, (f) means for slidably supporting said receptacle below said opening, (g) means extending between the lower ends of said end walls at said opening for limiting the size articles that can pass through said opening into said receptacle.

2. The device of claim 1 in which said means for slidably supporting said receptacle below said opening includes:

(a) lips carried by said receptacle for sliding engagement with (b) guides carried by said legs.

3. The device of claim 2 in which said means connecting the lower ends of said end walls for limiting the size of articles that can pass through said opening into said receptacle includes a multiplicity of spaced bars.

4. The device of claim 1 in which said means connecting the lower ends of said end walls for limiting the size of articles that can pass through said opening into said receptacle includes a multiplicity of spaced bars.

5. The device of claim 2 in which (a) said first spaced legs are connected by a first cross bar, and (b) said second spaced legs are connected by a second cross bar.

6. The device of claim 3 in which (a) said first spaced legs are connected by a first cross bar, and (b) said second spaced legs are connected by a second cross bar.

7. The device of claim 1 in which the lower ends of each of said intermediate walls is spaced from the lower edge of an end wall to allow debris to pass downwardly from each of said end walls below the lower ends of the intermediate walls, through said opening between the lower ends of the end walls and into the receptacle.

* * * * *